US005401012A

United States Patent [19]

Taruki

[11] Patent Number: 5,401,012

[45] Date of Patent: Mar. 28, 1995

[54] AUTOMATIC DOCUMENT FEEDER WITH SIDE BY SIDE DOCUMENT FEEDING CAPABILITY

[75] Inventor: Takashi Taruki, Hiratsuka, Japan

[73] Assignee: Ricoh Company, Ltd., Tokyo, Japan

[21] Appl. No.: 179,353

[22] Filed: Jan. 10, 1994

[30] Foreign Application Priority Data

Jan. 13, 1993 [JP] Japan ..... 5-003684

[51] Int. Cl.[6] ..... B65H 5/00

[52] U.S. Cl. ..... 271/10; 271/110; 271/233; 271/265; 271/270; 271/902

[58] Field of Search ..... 271/10, 110, 111, 227, 271/233, 265, 266, 270, 275, 902

[56] References Cited

U.S. PATENT DOCUMENTS 4,691,912 9/1987 Gilmann ..... 271/10
5,176,375 1/1993 Kitahara .
5,203,554 4/1993 Suzuki et al. ..... 271/10

FOREIGN PATENT DOCUMENTS 0225242 9/1990 Japan ..... 271/227

*Primary Examiner*—H. Grant Skaggs
*Attorney, Agent, or Firm*—Oblon, Spivak, McClelland, Maier & Neustadt

[57] ABSTRACT

An automatic document feeder having a 2-in-1 mode which serially locates first and second documents adjacent to one another at a copying position. The document feeder includes a separating part for separating documents one by one from a bundle of documents, a document feeding part for feeding documents at a speed which is faster than the transport speed provided by a document transporting part, with the transporting part located downstream from the feeding part. Since the feeding speed is faster than the speed of the transporting part, a space controlling part is provided for controlling a space between the first and second documents, such that after said space controlling part achieves a spacing of a predetermined distance, the document feeding part and the document transporting part transport the first and second documents and the first and second documents are placed serially on the contact glass without any undesired or excessive spacing between the first and second documents.

12 Claims, 5 Drawing Sheets

AUTOMATIC DOCUMENT FEEDER WITH SIDE BY SIDE DOCUMENT FEEDING CAPABILITY

BACKGROUND OF THE INVENTION

1. Field of the Invention

The invention relates to an automatic document feeder which is carried on a main body of an apparatus such as a copying machine, and particularly to an automatic document feeder capable of placing a pair of original documents side by side on a contact glass.

2. Description of the Related Art

In Japanese Laid Open Patent No. 63-93462 and Japanese Laid Open Patent No. 63-285563, a conventional automatic document feeder is disclosed. The automatic document feeder has an ordinary mode for feeding and transporting documents one by one, and a mode for serially placing an earlier fed document and the next document side by side on the contact glass (hereinafter referred to as a 2-in-1 mode). The automatic document feeder includes a document feeding part which comprises a separating member and a pair of pull-out rollers, and a document transporting part in the form of a transporting belt. The document feeding part separates and feeds documents one by one from a bundle of documents. The document transporting part transports the documents fed by the document feeding part to an exposing position on a contact glass sized to accommodate a pair of documents, where the main body of the apparatus performs an exposing operation. The document transporting part then discharges the documents from the exposing position after the exposing operations are carried out.

When the 2-in-1 mode is selected, the document feeding part separates and feeds a document (a first document) from a bundle of documents and the document transporting part transports the first document downward. The document transporting part then halts transportation of the first document after the trailing edge of the first document passes the pull-out rollers, and thereafter the document transporting part reverses the first document such that the first document contacts the downstream side of the pull-out rollers.

Next, the document feeding part separates and feeds the next document (the second document) and makes the leading edge of the second document contact the upstream side of the pull-out rollers, whereby the first and second documents are positioned. The document feeding part and the document transporting part are then driven and the first and second document are placed side by side at the exposing position on the contact glass.

The main body of the apparatus exposes the first and second documents and copies the document images of the first and second documents on one paper sheet (so-called 2-in-1 copy).

In this type of the automatic document feeder, as the trailing edge of the first document and the leading edge of the second document are adjusted at the downstream and upstream sides of the pull-out rollers, the leading edge of the second document can not directly contact with the trailing edge of the first document. In other words, the nip portion of the pair of pull-out rollers prevents the leading edge of the second document from directly contacting with the leading edge of the first document. As a result of the space between the trailing edge of the first document and the leading edge of the second document even when the first and second documents are transported to the exposing position on the contact glass, a part of the document image may extend beyond the exposing position and thus would not be properly copied onto a paper sheet.

Japanese Laid Open Patent 2-225241, proposes an automatic document feeder for overcoming the aforementioned problems. In this arrangement, after feeding and transporting a first document onto a contact glass, a transporting belt reverses the first document to abut the first document against a positioning member (a document scale), which is provided on an upstream side of the contact glass, whereby the first document is positioned in place. The second document is fed until a space between a leading edge of the second document and a trailing edge of the first document moves a predetermined distance by a feeding part, and the first and second documents are fed and transported downward together until the trailing edge of the second document passes over the positioning member. Further, the transporting belt is reversed by an amount corresponding to a total of a distance between the positioning member and the trailing edge of the second document, and a distance between the first and second documents, such that the trailing edge of the second document abuts against the positioning member. In addition, the trailing edge of the first document abuts against the leading edge of the second document and the space between the first and second documents is eliminated. However, to eliminate a space between the first and second documents, the transporting belt reverses twice. The reversing operation wastes time and causes a significant increase in noise (since the noise level increases at the point when the feeding is reversed) in order to serially place a pair of documents in this type of automatic document feeder.

SUMMARY OF THE INVENTION

The present invention has as an object to overcome the above and other problems encountered in the aforementioned art.

It is a further object of the present invention to provide an automatic feeding apparatus having a mode which efficiently serially places a pair of documents on a contact glass, without high noise levels, since reverse feeding can be reduced or eliminated.

It is another object of the invention to provide an automatic feeding apparatus having a mode which serially places a pair of documents side by side on a contact glass without a space between the first and second documents by one or less reversing operations of a document transporting part.

The above mentioned objects of the present invention are achieved by an automatic document feeder having a mode which serially places first and second documents side by side. The automatic document feeder includes a separating part for separating documents one by one from a bundle of documents, a feeding part for feeding documents, a transporting part for transporting documents, with the feeding speed of the feeding part faster than that of transporting part, and a space controlling part for controlling a space between the first and second document.

When the mode (2-in-1 mode) is selected and a document is fed by the feeding part and the transporting part, the space controlling part makes a distance between the trailing edge of the first document and the leading edge of the second document a predetermined value. After that, the leading edge of the second document abuts against the trailing edge of the first document while the first document is transported and the second document is fed, whereby the space between the first and second document is eliminated and the first and second documents are placed at the predetermined position on the contact glass.

BRIEF DESCRIPTION OF THE DRAWINGS

Other objects and further features of the present invention will become apparent from the following detailed description when read in conjunction with the accompanying drawings, wherein.

DESCRIPTION OF THE PREFERRED EMBODIMENT

Figure 1:
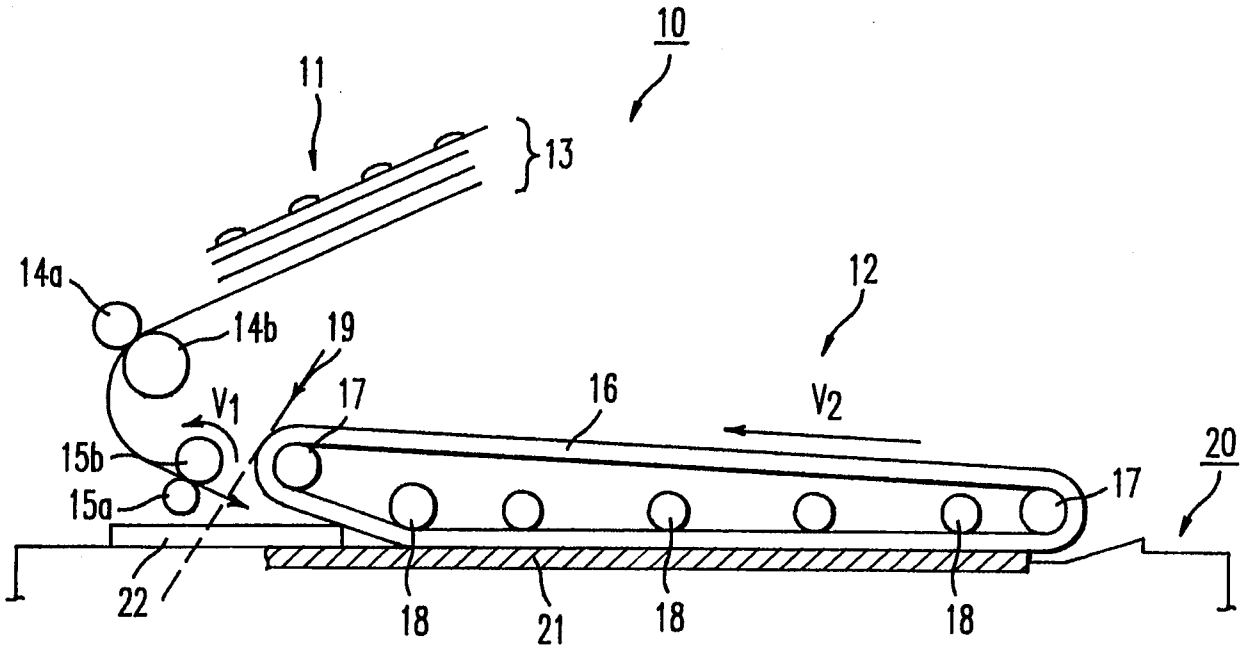
FIG. 1 is a side view showing an embodiment of an automatic document feeder according to the present invention.
Figure 2A:
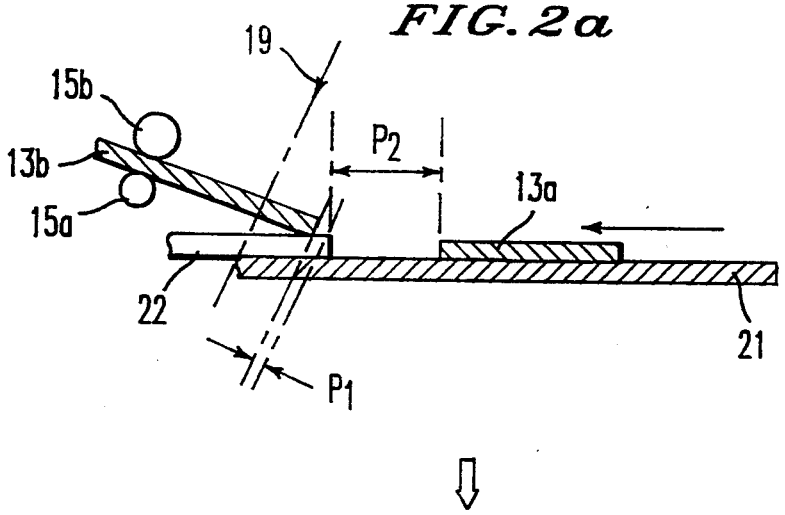
FIGS. 2 (*a*), (*b*), (*c*), (*d*) and (*e*) are schematic views explaining the operation of the automatic document feeder according to the FIG. 1 embodiment.
Figure 2B:
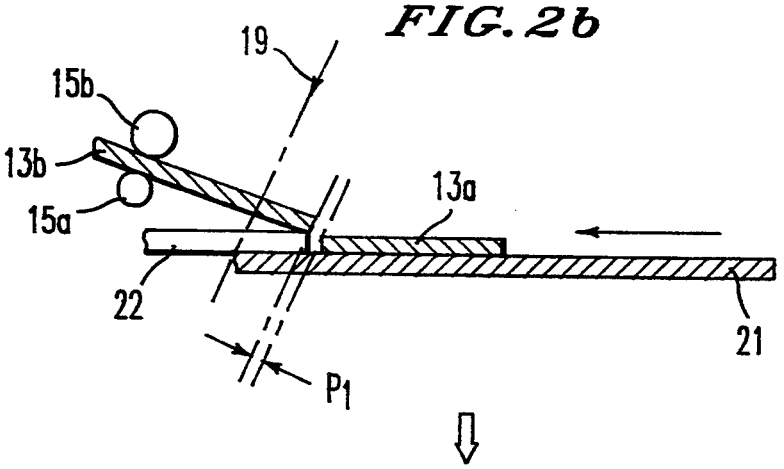
Figure 2C:
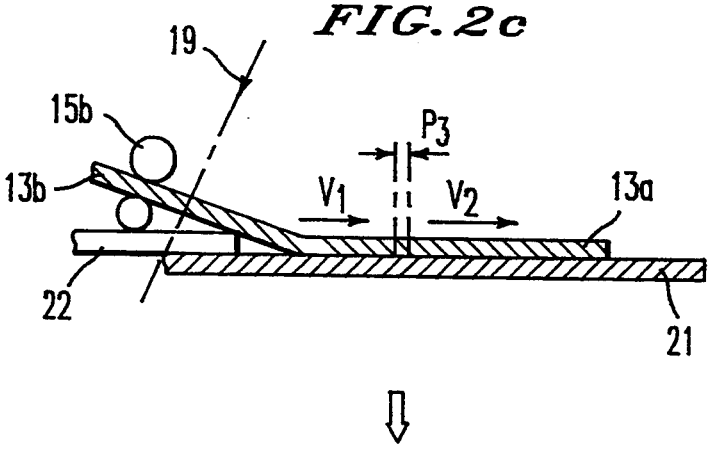
Figure 2D:
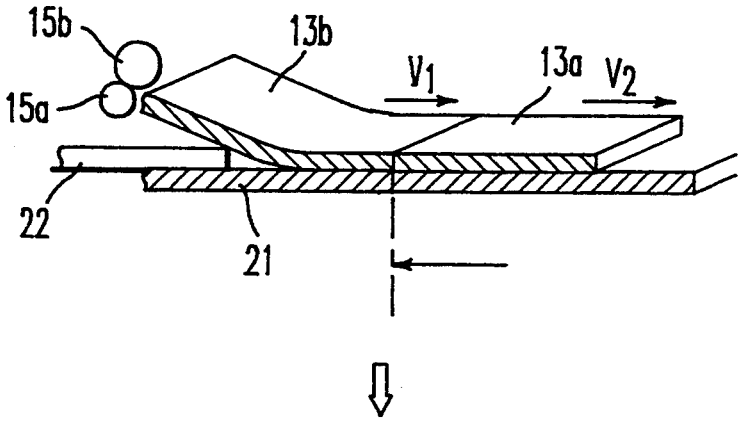
Figure 2E:
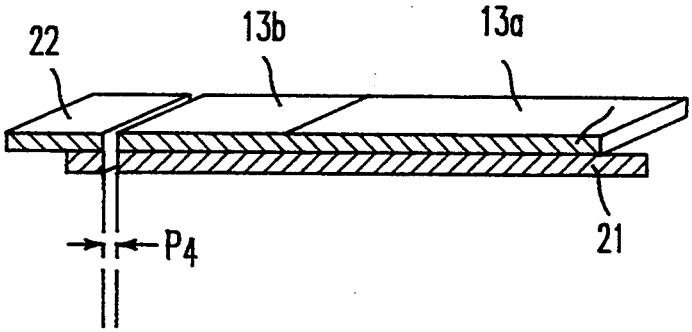

Referring now to the drawings, FIG. 1 depicts the structure of an automatic document feeder according to a first embodiment, which is provided on a main body of a copying machine. FIGS. 2 (*a*), (*b*), (*c*), (*d*) and (*e*) are views showing the operation of the first embodiment. As shown in FIG. 1, an automatic document feeder 10 is carried on a conventional copying machine 20 having a contact glass 21, with the document feeder capable of serially placing a pair of documents side by side. The automatic document feeder 10 has an ordinary mode and a 2-in-1 mode. In the ordinary mode, documents are automatically fed on the contact glass 21 one by one. In the 2-in-1 mode, an earlier fed document and the next document are placed side by side on the contact glass 21.

This automatic document feeder 10 includes a document feeding part 11 and a document transporting part, with the document feeding part 11 separating the documents one by one from a bundle of documents 13, and feeding the documents to the document transporting part 12. The document transporting part 12 transports the document to an exposing position on the contact glass 21 to expose the document by an exposing part (not shown) which is provided on the main body of the copying machine 20. After exposing, the document transporting part 12 discharges the documents from the exposing position. The ordinary mode is usually set as long as the 2-in-1 mode is not selected.

The document feeding part 11 includes a document table (not shown), a pair of separating rollers 14*a*, 14*b* and pull-out rollers 15*a*, 15*b*, with the document table capable of accommodating a bundle of documents 13. The separating rollers 14*a*, 14*b* separate documents one by one from a bundle 13 of documents on the document table. The pull-out rollers 15*a*, 15*b* feed the document separated by the separating roller 14*a*, 14*b*, to the document transporting part 12.

The separating roller 14*b* rotates in a feeding direction of documents. When a plurality of documents are caught between the rollers 14*a* and 14*b*, the separating roller 14*a* rotates in a direction opposite to the feeding direction of the documents, such that the lowest document of a bundle 13 on the document table is separated. The pull-out rollers 15*a*, 15*b* receive the separated document, and feed the document to the document transporting part 12 at a feeding speed V1. The separating roller 14*a* then rotates with separating roller 14*b* or stops when there is one or less documents between the rollers, and the pull-out roller 15*a* rotates with pull-out roller 15*b*.

The document transporting part 12 includes a transporting belt 16, a pair of driving rollers 17 and a plurality of pressing rollers 18. The transporting belt contacts the upper surface of the contact glass 21, and transports and reverses documents with respect to a feeding direction. The driving rollers 17 are disposed inside of the transporting belt 16 and drive the transporting belt 16. The pressing rollers 18 press the transporting belt 16 toward the contact glass 21 with a predetermined force.

With the transporting belt 16 pressing the document fed by the document feeding part 11 against contact glass 21, the transporting belt 16 transports the document at speed V2 to the exposing position and stops the document in the exposing position and then discharges it.

The document feeding part 11 and the document transporting part 12 can be driven by one driving motor (not shown), and a plurality of gears transmit the driving force of the driving motor to the separating rollers 14*a*, 14*b*, the pull-out roller 15*b* and the driving rollers 17. The gear ratio is set so that the feeding speed V1 is larger than the transporting speed V2 ($V1>V2$). One of the gears for transmitting the driving force of the driving motor to the document feeding part 11 has a spring clutch, whereby the document feeding part 11 does not rotates when the transporting belt 16 reverses.

A pulse generator for detecting a rotation amount is provided on the driving motor. The pulses based on the rotation of the pulse generator is sent to a control unit, whereby the rotation amount of the pull-out roller 15*b* and the driving roller 17 are detected. Accordingly, the driving amount of the document feeding part 11 and the document transporting part 12 are detected. The pulse generator thus constitutes a driving amount or feeding distance detecting part.

A document detecting sensor 19 is positioned along the feeding path at a downstream side of the pull-out roller 15, with the document detecting sensor 19 detecting the leading edge and/or the trailing edge of the fed documents and sending the detected information to the control unit. When the control unit receives the detected information, the control unit drives the document feeding part 11 and/or the document transporting part 12 in a predetermined amount based on the detected information and the driving amount information detected by the driving amount detecting part, whereby the documents are positioned.

The control unit comprises a CPU, a memory and I/O circuit, and controls driving of the document feeding part 11 and the document transporting part 12 based on the controlling signals from the main body of the copying machine 20, information detected by a group of sensors such as the document detecting sensor 19, and information detected by the pulse generator (number of pulses). Accordingly, the control unit drives the document feeding part and the document transporting part 12 using the information according to control programs, which are recorded in an internal memory beforehand, in response to the selected ordinary mode or the 2-in-1 mode.

In the 2-in-1 mode, after the document detecting sensor 19 detects a trailing edge of a first document and/or a leading edge of the second document, the control unit drives the document feeding part 11 and/or the document transporting part 12 until a pulse number reaches a predetermined value so that the documents are transported to a desired position. During that time, the control unit is detecting a pulse number of the pulse generator. As a result, a space between a trailing edge of an earlier fed document and a leading edge of the next document is a predetermined distance, or known distance.

After that, the document feeding part 11 and the document transporting part 12 are driven at different speeds, such that the documents are transported side by side onto the contact glass 21 without a space between the documents. The control unit provides a drive control in response to information received from the document detecting sensor 19 and the pulse generator, and the control unit thus functions as a space controlling part.

After a document runs over the exposing position based on the information from the document detecting sensor 19 which has detected a trailing edge of the first document, the transporting belt 16 reverses so that the document abuts against the positioning member 22 (the document scale) to correct skewing of the document and to position the document. The positioning member 22 is provided on the main body of the copying machine 20 and at an upstream side of the contact glass 21. Further, based on the information from the document detecting sensor 19 indicating that the leading edge of the second document has been detected, the control unit can drive the transporting belt 16 by a desired amount which is determined by the sensing of a predetermined number of pulses with the transporting belt transporting the first document in the reverse direction, whereby the first document is stopped so that the trailing edge of the first document is adjacent to the positioning member 22. Preferably, it is possible to select an abutting mode for abutting a document against the positioning member or a non-abutting mode for positioning a document without abutting by a selecting switch, with the selecting switch provided on the main body of the copying machine 20. It is possible for an operator to select one of the two modes using the selecting switch, for example based on the thickness of the documents.

When the 2-in-1 mode is selected by a selecting switch, the document feeding part 11 and/or the document transporting part 12 are/is controlled based on the information of a trailing edge of an earlier fed document (a first document) or a leading edge of the next document (a second document) which the document detecting sensor 19 detects. After a predetermined space between the first and second documents is achieved, the document feeding part 11 is driven at a feeding speed V1 and the document transporting part 12 is driven at a feeding speed V2 (V1>V2). The first and second documents are transported by an amount determined as a predetermined number of pulses and based on the information of the trailing edge of the second document which the document detecting sensor 19 detects so that the trailing edge of the second document is adjacent to the positioning member 22, whereby the first and second documents are serially placed side by side in the exposing position without a space between the first and second document.

Next, a description will be given of operation of the ordinary mode and the 2-in-1 mode.

Ordinary mode

Upon setting a bundle of documents 13 on the document table and pressing a start key which is provided on the main body of the copying machine, the separating rollers **14*a* and 14*b* separate documents from the bundle of documents one by one and then the pull-out rollers 15*a*, 15*b* feed the document to the transporting belt 16. After the document detecting sensor 19 detects the trailing edge of the document, the transporting belt 16 transports the document to the exposing position on the contact glass 21** according to a selected mode (i.e. the abutting mode or the non-abutting mode). Next, after an exposing operation of the main body of the copying machine is completed, the document is discharged from the exposing position. As this mode is well known, the description is omitted.

2-in-1 Mode

When selecting the 2-in-1 mode by the selecting switch and pressing the start key, the separating rollers **14*a*, 14*b* separate a document from a bundle of documents 13. As shown in FIG. 2** (*a*), the pull-out rollers **15*a*, 15*b* feed a first document 13*a* and the transporting belt 16 transports the first document to the contact glass 21. When the document detecting sensor 19 detects the trailing edge of the first document 13*a*, the separating rollers 14*a*, 14*b* and pull-out rollers 15*a*, 15*b* separate and feed the next document (a second document). When the document detecting sensor 19 detects the leading edge of the second document 13*b* and thereafter a pulse count of the pulse generator reaches a predetermined value, the control unit halts the document feeding part 11 and the document transporting part 12**.

At this time, the trailing edge of the document **13*a* stops at a position downstream from an end of the positioning member 22 by a distance p2. The leading edge of the document 13*b* stops in a position which is upstream from an upstream end of the positioning member 22 by a distance p1. After that, the control unit drives the transporting belt 16 so that the first document 13*a* is reversed (switched back) by an amount equal to the distance p2 and preferably by an amount slightly greater than p2 to compensate for any slippage between the belt and the first document. As shown in FIG. 2** (*b*), only the document **13*a* is reversed and abuts against the positioning member 22. At that time, a space between the documents 13*a* and 13*b*** becomes p1.

As shown in FIG. 2 (*c*), the transporting belt 16 then transports the document **13*a* at the transporting speed V2, and the pull-out rollers 15*a* and 15*b* feed the document 13*b* at the feeding speed V1. At that time, as the relation of the transporting speed V1 and the feeding speed V2 is V1>V2, a space between the documents 13*a* and 13*b* becomes a distance p3 and the space p3 becomes narrower and narrower as a result of the different feeding/transporting speeds. As shown in FIG. 2** (*d*), before the trailing edge of the document **13*b* passes through the document detecting sensor 19, the space p3 is eliminated (p3=0). When the space is eliminated (p3=0), a position of the trailing edge of the first document 13*a* and the leading edge of the second document 13*b* is between the transporting belt 16 and the contact glass 21. Since the pressing rollers 18 press the transporting belt 16 and the documents 13***a* and 13*b* cling to the contact glass 21 by the pressing, the first document 13*a* and the second document 13*b* do not overlap or interfere with one another (which interference could result in bending or folding of the documents).

The first document 13*a* and the second document 13*b* are transported at transporting speed V2 by the transporting belt 16. After the document detecting sensor 19 detects the trailing edge of the second document 13*b* and the transporting belt 16 transports the documents by a desired amount as determined by the sensing of a predetermined number of pulses, the document feeding part 11 and the document transporting part 12 stop. The first documents 13*a* and the second document 13*b* are serially placed side by side in a position where a space between the trailing edge of the second document 13*b* and an upstream end side of the positioning member 22 is p4 (for example, with p4=0 to 1 mm). At that time, there is no space between the first document and the second document.

After that, the main body of the copying machine 20 reproduces the images of the documents 13*a* and 13*b* on one paper sheet by simultaneously exposing the documents 13*a* and 13*b*. After the exposing operation, the documents 13*a* and 13*b* are discharged, and the operations are repeated with the 2-in-1 mode is carried out without a space between a first document and a second document. It is possible to discharge the first and second documents from the contact glass 21 at a speed which is faster than the transporting speed V2. It is also possible to discharge the document 13*b* after discharging the document 13*a*. For more efficient operation in a high speed copying machine, it is preferable to discharge the document at a faster speed than the transporting speed V2.

In this embodiment, when the 2-in-1 mode is selected, a space between a trailing edge of a first document and a leading edge of a second document is set to a predetermined amount p1 by reversing the document 13*a* only once by the control unit. Since the pull-out rollers 15*a* and 15*b* of the document feeding part transport the second document 13*b* at a feeding speed V1 which is faster than the transporting speed V2 of the document transporting part, the leading edge of the second document 13*b* abuts against the trailing edge of the first document 13*a* and the space between the documents 13*a* and 13*b* is eliminated during the period in which the document transporting part 12 transports the first document 13*a* and the document feeding part 11 feeds the second document 13*b*, whereby the first and second documents 13*a* and 13*b* are serially placed on the contact glass 21 of the main body of the copying machine without a space therebetween. Therefore, the 2-in-1 mode can be carried out efficiently and without excessive noise.

In this embodiment, a document set sensor is provided on the document table and a feeding document counting part is also preferably provided. In the situation where the number of documents is odd, when the document set sensor does not detect any document on the document table and a number counted by the feeding document count part is odd, the document already fed by the document feeding part is transported to the exposing position without waiting for feeding of the next document.

A description will be given of an operation of another embodiment according to the present invention with reference to FIGS. 3 (*a*), (*b*) and (*c*), wherein like numbers are utilized for the corresponding elements of the first embodiments, with redundant descriptions omitted.

In this embodiment, the document feeding part 11 and the document transporting part 12 respectively have a separate motor or separate drive, and the control unit controls these motors separately. When the 2-in-1 mode is selected by the selecting switch, after the document feeding part 11 separates and feeds the document 13*a* and after the document detecting sensor 19 detects the trailing edge of the document 13*a*, the document transporting part 12 transports the document to a position downstream from the detecting position of the document detecting sensor 19 by a distance p5 as shown in FIG. 3 (*a*). That is, the document transporting part 12 transports the document until a number of pulses reaches a predetermined value. Next, as shown in FIG. 3 (*b*), the document 13*b* is separated and fed by the document feeding part 11 and stopped at a position where the leading edge of the document 13*b* is detected by the document detecting sensor 19. At that time, a predetermined spacing between the first and second documents 13*a*, 13*b* is achieved as represented by distance p6 in FIG. 3(*b*).

Figure 3A:
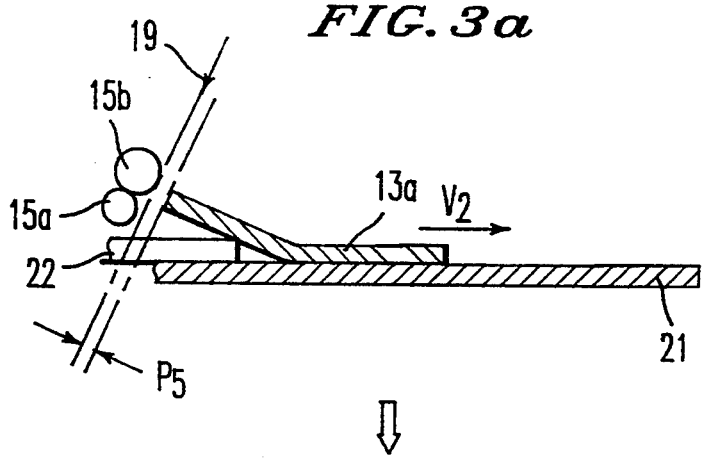
FIGS. 3 (*a*), (*b*) and (*c*) are schematic views explaining the operation of an automatic document feeder according to a second embodiment.
Figure 3B:
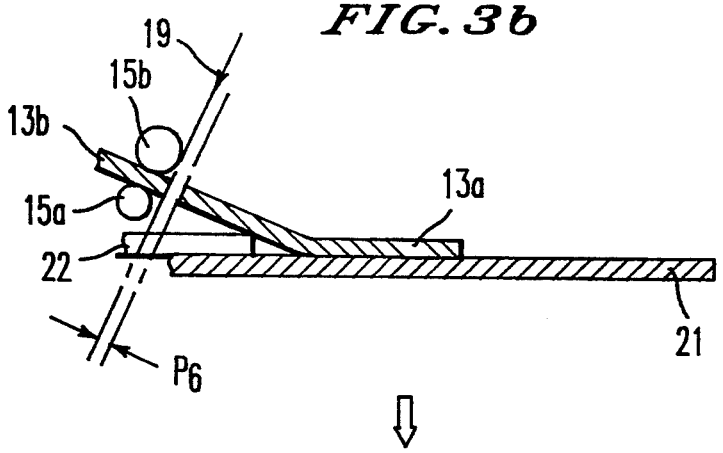
Figure 3C:
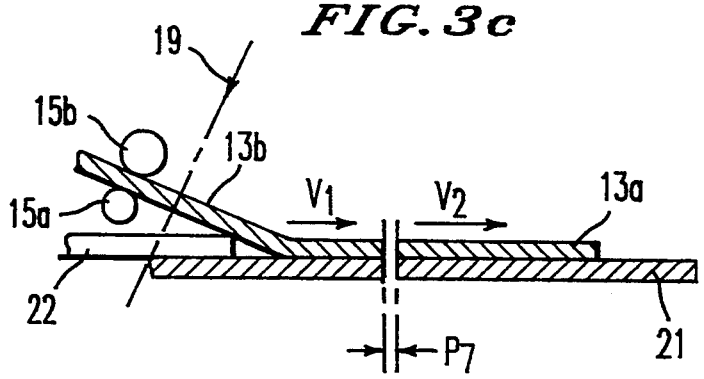

Next, as shown in FIG. 3 (*c*), the transporting belt 16 transports the document 13*a* at the transporting speed V2 and the pull-out rollers 15*a*, 15*b* feed the document 13*b* at the feeding speed V1. At this time, as the relation between the feeding speed V1 and the transporting speed V2 is V1>V2, a space p7 between the documents 13*a* and 13*b* becomes narrower and narrower. As the differential speed feeding continues, the space p7 is eliminated (p7=0) as in the first embodiment, before the trailing edge of the document 13*b* passes through the document detecting sensor 19. Therefore, the 2-in-1 mode is carried out with no space between the first and second documents when they are positioned on the glass, and with the feeding/positioning accomplished without reversing the transporting belt.

As mentioned above, in this embodiment, adding to the effects of the first embodiment, the space p6 between the trailing edge of the document 13*a* and the leading edge of the document 13*b* can be set without reversing feeding of the document 13*a* by providing separate drive motors, or separately controllable driving arrangements for the document feeding part 11 and the document transporting part 12, and further the documents 13*a* and 13*b* are serially placed side by side on the contact glass 21 without any space (or at least without an excessive space) between the documents. Accordingly, the 2-in-1 mode is carried efficiently without noises associated with reversing the transport direction. Similar effects can be achieved by providing a clutch for decoupling the driving force to the document feeding part 11 if one motor drives both the document feeding part 11 and the document transporting part 12, and thus operation as in the second embodiment can be accomplished by separately controllable drive arrangements even though a common drive source is utilized.

In the foregoing embodiments, the pulse generator is used as the driving amount detecting part of the document feeding part 11 and the document transporting part 12. However, other feeding/driving determining arrangements may be utilized to determine the position or feeding amount of the documents. For example, it is possible to use a timer function of a CPU of the control unit. It is also possible to drive the document feeding part 11 and the document transporting part 12 for a predetermined time after the leading or the trailing edges of the documents 13*a* and 13*b* are detected.

Figure 4:
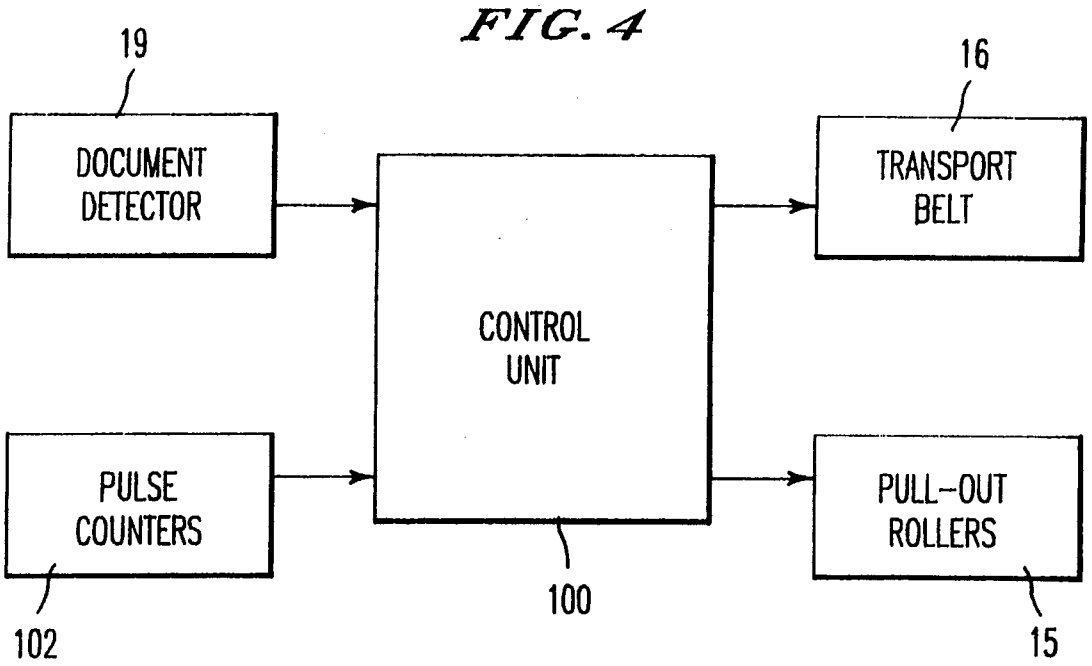
FIG. 4 schematically depicts a control arrangement for the present invention.

Referring briefly to FIG. 4, a schematic of the control arrangement for operating the 2-in-1 mode in accordance with the present invention is shown. As shown in FIG. 4, the control unit 100 receives information from the document sensor 19 and pulse counter 102, and in response controls the feeding/transporting operations of the transport belt 16 and pull out rollers 15 to achieve the operations discussed hereinearlier. Of course, where separately controllable driving arrangements are not provided for the belt 16 and rollers 15 (as in the FIG. 2 embodiment), the control unit need only control a single drive.

As should be readily apparent from the foregoing, the present invention provides a reliable arrangement for positioning documents side by side for a 2-in-1 copying operation by first establishing a predetermined spacing between the first and second documents, and thereafter feeding the first and second documents at different speeds in order to eliminate the spacing therebetween. The spacing between the first and second documents may also be allowed to vary (i.e., the spacing prior to the final differential speed feeding onto the contact glass) and the spacing can be determined (e.g. based upon information from the document sensor and pulse counter), and the differential speed feeding may also be varied based upon the determined spacing such that the spacing is eliminated in the final feeding to the glass.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the Unites States is:

1. An automatic document feeder having a mode to serially place a first document and a second document side by side comprising:

separating means for separating documents one by one from a bundle of documents;

feeding means for feeding documents separated by said separating means;

transporting means for transporting documents which have been fed by said feeding means, wherein a feeding speed of said feeding means is faster than a transporting speed of the transporting means; and a space controlling means for controlling a space between the first and second documents;

wherein said space controlling means achieves a predetermined spacing distance between said first and second documents and thereafter the feeding means and the transporting means transport the first and second documents such that the first and second documents are placed serially side by side on a contact glass without a space therebetween.

2. An automatic document feeder according to claim 1, wherein said space controlling means comprises:

document detecting means for detecting a trailing edge of the first document and a leading edge of the second document;

driving amount detecting means for detecting a driving amount of said feeding means; and drive controlling means for controlling said feeding means and said transporting means based on information from said document detecting means and said drive amount detecting means.

3. An automatic document feeder for feeding a first document and a second document to a copying position such that said first and second documents are side by side at said copying position comprising:

a feeding unit for feeding documents;

a transporting unit located downstream from said feeding unit for transporting documents after being fed by said feeding unit; and a control unit for controlling said feeding unit and said transporting unit such that a first document is initially fed by said feeding unit and into said transporting unit, and thereafter a second document is fed with a known spacing established between a trailing edge of said first document and a leading edge of said second document while said first document is engaged by said transporting unit and said second document is engaged by said feeding unit, and after establishing said known spacing said control unit causes said feeding unit to operate at a greater speed than said transporting unit such that when said first and second documents arrive at a copying position the first and second documents are side by side to each other.

4. The automatic document feeder of claim 3, wherein said control unit includes means for establishing said known spacing by feeding said first document in a direction opposite to a feeding direction by said transporting unit while said second document is held by said feeding unit.

5. The automatic document feeder of claim 3, wherein said control unit includes means for establishing said known spacing by holding said first document by said transporting unit and feeding said second document toward said first document by said feeding unit.

6. The automatic document feeder of claim 3, further including a document sensor disposed to sense documents at a location between said feeding unit and said transporting unit.

7. The automatic document feeder of claim 6, further including pulse generating means for generating feed pulses corresponding to feeding by at least one of said feeding unit and said transporting unit.

8. The automatic document feeder of claim 7, wherein said control unit includes means for feeding said second document a predetermined distance by said feeding unit after a leading edge of said second document is detected by said document sensor to thereby establish said known spacing, said predetermined distance determined by counting a predetermined number of feed pulses generated by said means for generating feed pulses after said leading edge of said second document is sensing said document sensor.

9. A method for feeding a pair of documents such that said pair of documents arrive at a copying location in side by side relation comprising:

feeding a first document;

feeding a second document;

establishing a known spacing between a trailing end of said first document and a leading end of said second document; and after establishing said known spacing, feeding both of said first and second documents, with said second document fed at a speed greater than said first document such that said known spacing progressively decreases whereby said first and second documents are side by side when positioned at a copying position.

10. The method of claim 9, wherein the step of establishing a known spacing includes feeding said second document a predetermined distance after sensing a leading end of said second document by a document sensor.

11. The method of claim 9, wherein the step of establishing a known spacing includes feeding said first document a predetermined amount after sensing a trailing end of said first document.

12. The method of claim 9, wherein the step of feeding said second document at a greater speed than said first document includes feeding said first document by a transporting belt located adjacent a contact glass and feeding said second document by a pair of rollers upstream from said transporting belt.

* * * * *